US005502869A

United States Patent [19]

Smith et al.

[11] Patent Number: 5,502,869

[45] Date of Patent: Apr. 2, 1996

[54] HIGH VOLUME, HIGH PERFORMANCE, ULTRA QUIET VACUUM CLEANER

[75] Inventors: Dexter G. Smith, Columbia; Christopher P. Nowicki, Elkridge; Michael F. Arnold, Westminster, all of Md.

[73] Assignee: Noise Cancellation Technologies, Inc., Linthicum, Md.

[21] Appl. No.: 329,921

[22] Filed: Oct. 27, 1994

Related U.S. Application Data

[63] Continuation-in-part of Ser. No. 15,100, Feb. 9, 1993, abandoned.

[51] Int. Cl.[6] ..... A47L 9/00

[52] U.S. Cl. ..... 15/326; 381/71

[58] Field of Search ..... 15/326; 381/71

[56] References Cited

U.S. PATENT DOCUMENTS 4,122,303 10/1978 Chaplin et al. .
4,423,289 12/1983 Swinbanks .
4,480,333 10/1984 Ross .
4,878,188 10/1989 Ziegler, Jr. .
5,091,953 2/1992 Tretter .
5,105,377 4/1992 Ziegler, Jr. .

FOREIGN PATENT DOCUMENTS 84921 3/1992 Japan ..... 15/326
187131 7/1992 Japan ..... 15/326
189331 7/1992 Japan ..... 15/326
5-3841 1/1993 Japan .
5-3843 1/1993 Japan .
5-7536 1/1993 Japan .

*Primary Examiner*—Chris K. Moore
*Attorney, Agent, or Firm*—James W. Hiney

[57] ABSTRACT

An ultra quiet vacuum cleaner having a bag cavity (44), a motor/blower chamber (48) connected to said cavity by a flexible coupling (47) and an active, adaptive noise cancellation controller (52) so configured to quiet the exhaust of the air used to cool the motor/blower unit. Fast compensation and feedback compensation allow use of a straight, short duct (51) for superior cancellation performance.

9 Claims, 6 Drawing Sheets

HIGH VOLUME, HIGH PERFORMANCE, ULTRA QUIET VACUUM CLEANER

This is a continuation-in-part of U.S. patent application, Ser. No. 08/015,100, filed Feb. 9, 1993, now abandoned, and entitled "Ultra Quiet Vacuum Cleaner".

TECHNICAL FIELD

This invention relates to an improved arrangement of a vacuum cleaner to reduce the overall noise level and increase suction performance. Complimentary passive and active control methods have been used to design a vacuum cleaner from a noise containment and attenuation point of view. The method and apparatus to which this invention relates has resulted in a high performance, mass produced vacuum cleaner with superior radiated acoustic performance and increased hydraulic performance in comparison to vacuum cleaners of the same class. This invention relates to vacuum cleaners of all sizes that need to reduce broad band noise, with or without tonal components present. Previous vacuum designs had size, weight, and performance, but seldom noise, as the primary concerns. Designing a vacuum cleaner solely from a noise point of view clearly separates the noise sources. These sources can be attacked with the most cost effective means, either using active, passive or a combination of the two. Previous active techniques have required long ducts wrapped around the vacuum cleaner body. Superior performance is achieved in this invention utilizing a short, straight duct for cancellation.

BACKGROUND ART

The term vacuum cleaner encompasses a wide variety of appliances that use negative pressure to collect various solids and even liquids into a collection area for disposal. The heart of any vacuum cleaner is the motor/blower unit. This is typically a universal motor with one or more stages of fan blades attached. A typical household unit might be a two horsepower motor with a two stage backward curved fan system. One fan might have six blades and the other seven. On the inlet side of the motor/blower is the bag cavity area. Here, the negative pressure developed by the motor/blower is transferred to the hose and nozzle by the bag volume. There may be one or more filters in addition to the bag to keep dust and large particles from damaging the motor/blower. The outlet of the motor/blower is exhausted to the environment usually through some type of dust filter.

The following patents describe the active noise control system used and are hereby incorporated by reference herein; U.S. Pat. No. 5,091,953 to Tretter, U.S. Pat. No. 5,105,377 to Ziegler, U.S. Pat. No. 4,878,188 to Ziegler and U.S. Pat. No. 4,122,303 to Chaplin et al. This invention incorporates several of the methods and apparatus described to actively cancel noise produced by the vacuum. The multi-channel digital virtual earth system disclosed by the cited references to Tretter and Ziegler are incorporated by reference herein. Ziegler in U.S. Pat. No. 4,878,188, shows a selective active cancellation system for repetitive phenomena which, as stated, is used in duct systems and is "fast adapting" to cancel repetitive and random noise. An improvement of this system is given in Ziegler, U.S. Pat. No. 5,105,377, which allows fast adapting digital virtual earth without a reference signal. The Tretter patent builds on Ziegler, U.S. Pat. No. 5,105,377 and shows the same system with interacting multiple sensors and actuators. Chaplin et al in U.S. Pat. No. 4,122,303, uses two microphones as noise sensor and residual error sensor as described in the specification and disclosure.

Several Japanese patents describing how an active cancellation system is incorporated into a vacuum cleaner are referenced herein; Japanese patent number 5-3841 to Tanaka, Japanese patent number 5-3843 to Iida and Japanese patent number 5-7536 to Saito. The patents by Iida, Tanaka and Saito are limited in effectiveness for canceling broadband noise because the duct is wrapped or bent. This results in poor signal matching between the reference and residual error microphone which results in poor cancellation performance. The reason the duct is wrapped is because of slow processor speeds to avoid feedback from the speaker to the reference microphone and to reduce overall size of the vacuum at the expense of the dust bag capacity. The feedback is not compensated for in the control system.

SUMMARY OF THE INVENTION

The vacuum cleaner designed following the teachings of this invention, using passive and active noise control methods, has resulted in a vacuum cleaner with superior acoustic performance and comparable hydraulic performance to similar units. Random broad band noise, tonal noise or a combination of both can be reduced depending on the exact configuration of the vacuum cleaner.

The noise sources in the newly designed vacuum cleaner are as follows:

1. Nozzle
2. Hose
3. Bag Cavity
4. Coupling
5. Motor/Blower
6. Exhaust Duct

Fast computation time and utilization of a feedback compensation filter allows the use of a short, straight duct in this invention, a duct much shorter in length than those shown in the three Japanese patents cited herein. The filter mentioned compensates for feedback from the speaker to the reference microphone. In the prior art, this feedback is reduced by use of the long duct, curved as shown.

The nozzle and hose are not addressed in this invention. After the other noise sources are reduced, the nozzle and hose will be the remaining major noise sources in the vacuum. Further reductions in noise level can result by redesigning these two components.

Accordingly, it is an object of this invention to provide a vacuum cleaner that employs active noise control.

It is also an object of this invention to provide superior active noise control using a short, straight duct for cancellation.

Another object of this invention is to provide a vacuum cleaner that employs both active and passive noise control.

A further object of this invention is to provide a unique acoustic design and isolation techniques on the bag cavity, motor/blower area and coupling on a vacuum cleaner to provide cost effective active noise control thereto.

Yet another object is to provide a vacuum cleaner with a short exhaust duct with active noise reduction having a feedback compensation filter.

These and other objects will become apparent when reference is had to the accompanying drawings in which FIGS. 1 and 2 are adaptive noise cancellation concepts of the prior art, FIG. 3 is a typical linear flow noise cancellation application, FIG. 4 is a block diagram of the system in FIG. 3, FIG. 5 is an elevation view of a vacuum cleaner showing major active noise control components, FIG. 6 is another embodiment of the vacuum cleaner shown in FIG. 5, FIG. 7 is another embodiment of the vacuum cleaner shown in FIGS. 5 and 6, FIG. 8 a graph of the sound power reduction between this invention and a standard vacuum using the same motor, FIG. 9 is the sound power reduction as a result of using an active control system, and FIG. 10 is the suction performance improvement between this invention and a standard vacuum using the same motor.

DETAILED DESCRIPTION OF THE DRAWINGS

An important issue involved in designing a practical vacuum cleaner system is arranging components in a manner consistent with all design goals such as low noise, superior suction performance, and high volume producibility. Each component is addressed for three design goals separately and as a whole system. For cost, only one active noise control system is allowed and thus was used to reduce the loudest noise source in the system, the motor/blower unit.

Since the motor/blower unit discharge noise is broadband (noise that extends over a large frequency bandwidth) with perhaps tonals and harmonics related to blade passage or mechanical rotation of the shaft, a broadband Adaptive FeedForward (AFF) algorithm was chosen. This algorithm can be implemented wherever noise can be contained and directed down a duct. Therefore, it is important to have a well designed passive vacuum cleaner that has the majority of the radiated noise coming out of the exhaust duct.

Figure 1:
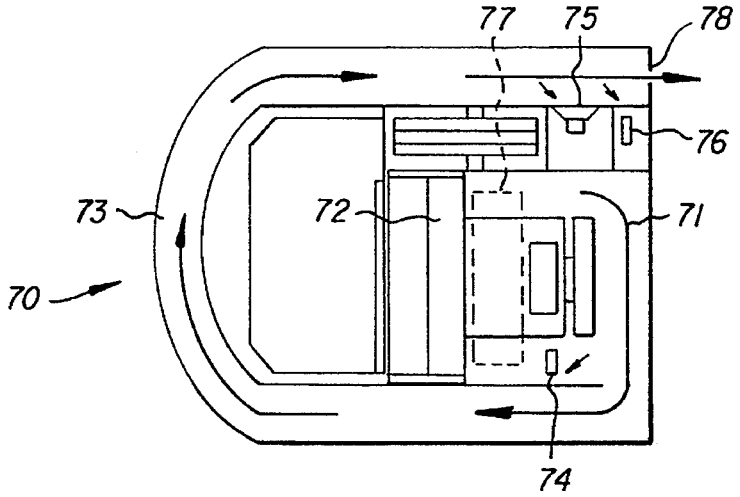
Fig. 1 PRIOR ART

FIG. 1 shows a prior art vacuum with noise cancellation shown in published Japanese patent application no. 3-157990 to Tanaka and Iida. The vacuum cleaner 70 has an exhaust chamber 71 in which an air blower 72 is contained, an elongated exhaust duct 73 is provided and an active noise canceling device is placed. The noise canceling device includes noise detecting microphone 74, loudspeaker 75, a monitor microphone 76 and a control circuit 77. Control circuit 77 and its components are integrated into the exhaust chamber 71 and exhaust duct 73. The exhaust noise generated by driving the air blower 72 is propagated through duct 73 from the exhaust chamber 71 and emitted to the outside. Microphone 74 detects the noise and a control signal is generated causing loudspeaker 75 to emit a reverse phase sound wave to attempt to cancel the noise. Ideally, the sound emitted at exhaust port 78 should be zero. Residual microphone 76 detects any noise not canceled and submits that signal to control system 77 for an adjustment to be made. Exhaust duct 73 is wrapped all around the vacuum 70 in order to reduce any feedback in the system.

Figure 2A:
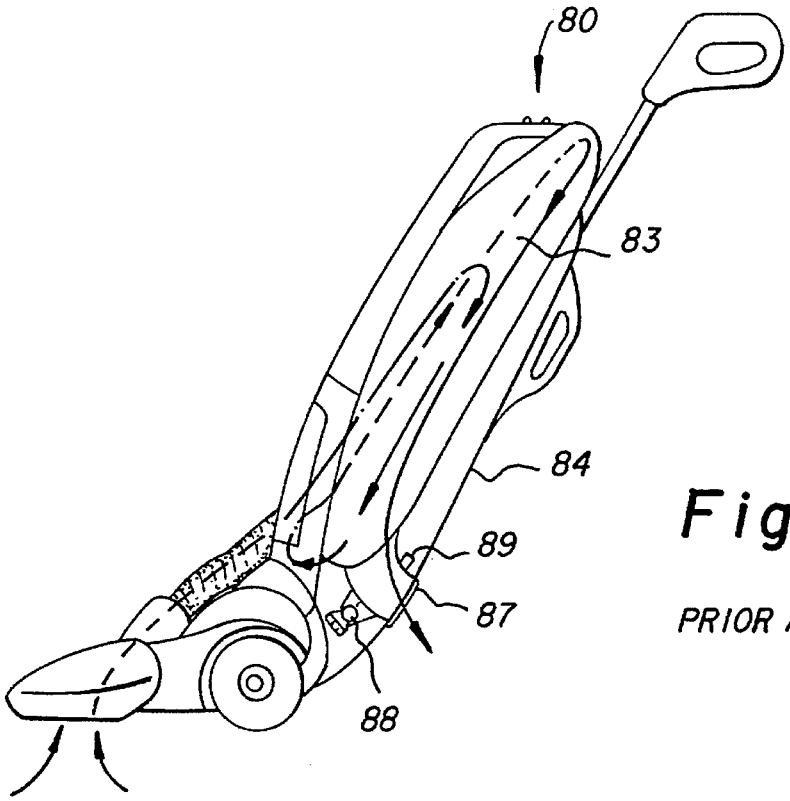
Fig. 2A PRIOR ART
Figure 2B:
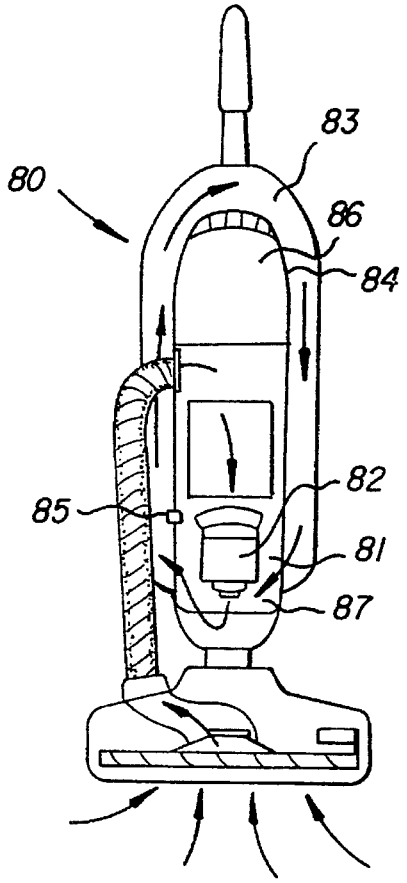
FIG. 2B PRIOR ART

FIG. 2 shows another prior art vacuum cleaner 80 with active noise reduction shown in Japanese patent application number 3-165573 to Saito. An exhaust chamber 81 incorporating an electromotive air blower 82 and exhaust duct 83 surrounds case 84 of the main body. Exhaust chamber 81 and duct 83 incorporate microphone 85, a speaker 88, a monitor 89 and control circuit 86. Exhaust noise generated by driving air blower 82 is passed to the outside through elongated, bent duct 83. Noise is detected by microphone 85 which feeds a signal to controller 86 to cause the loudspeaker to emit a noise canceling wave form. Exhaust port 87 allows the now quieted exhaust to escape to the atmosphere.

Both prior art cleaners use very long, curved exhaust ducts. The instant invention utilizes a short straight duct.

Figure 3:
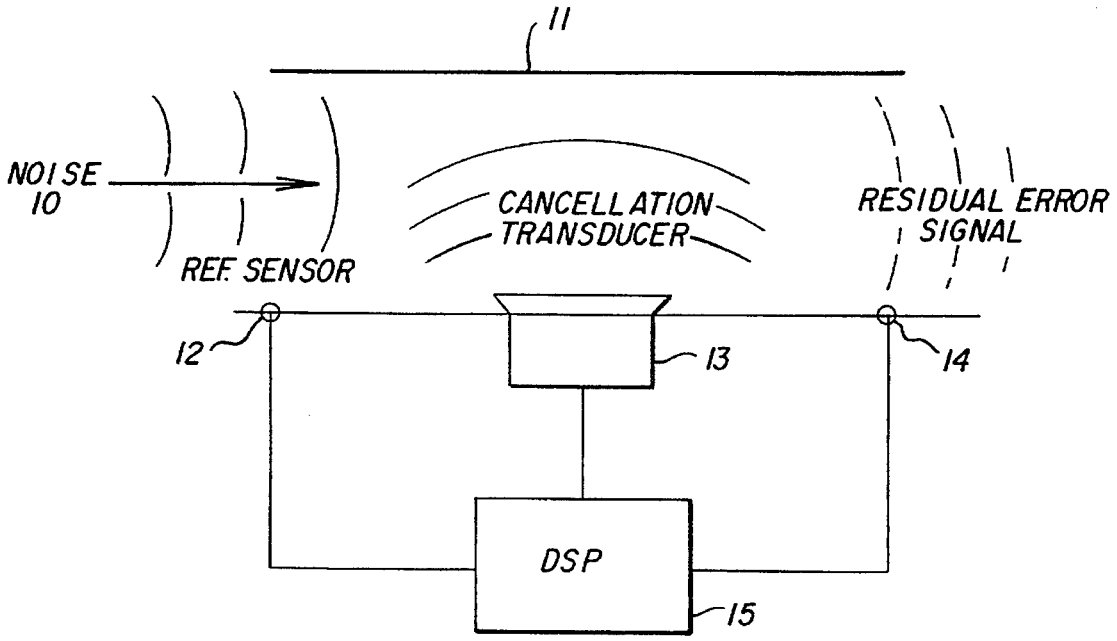

FIG. 3 shows a typical linear flow noise cancellation application. Noise 10 enters sound conductor 11 which could be a pipe or duct and propagates at the speed of sound. At some point in the duct 11, noise 10 is measured by reference sensor 12 in the duct wall. Digital signal processor system (DSP) 15 calculates a signal to attenuate noise 10 and injects this signal into duct 11 through cancellation transducer 13, e.g., a loudspeaker mounted to emit its noise into duct 11. The residual noise after mixing noise and anti-noise is measured by sensor 14 which is in the duct wall. The residual error sensor signal and the reference sensor signal are digitally processed by DSP system 15 to continually generate a signal that minimizes the residual error signal power seen at sensor 14.

Figure 4:
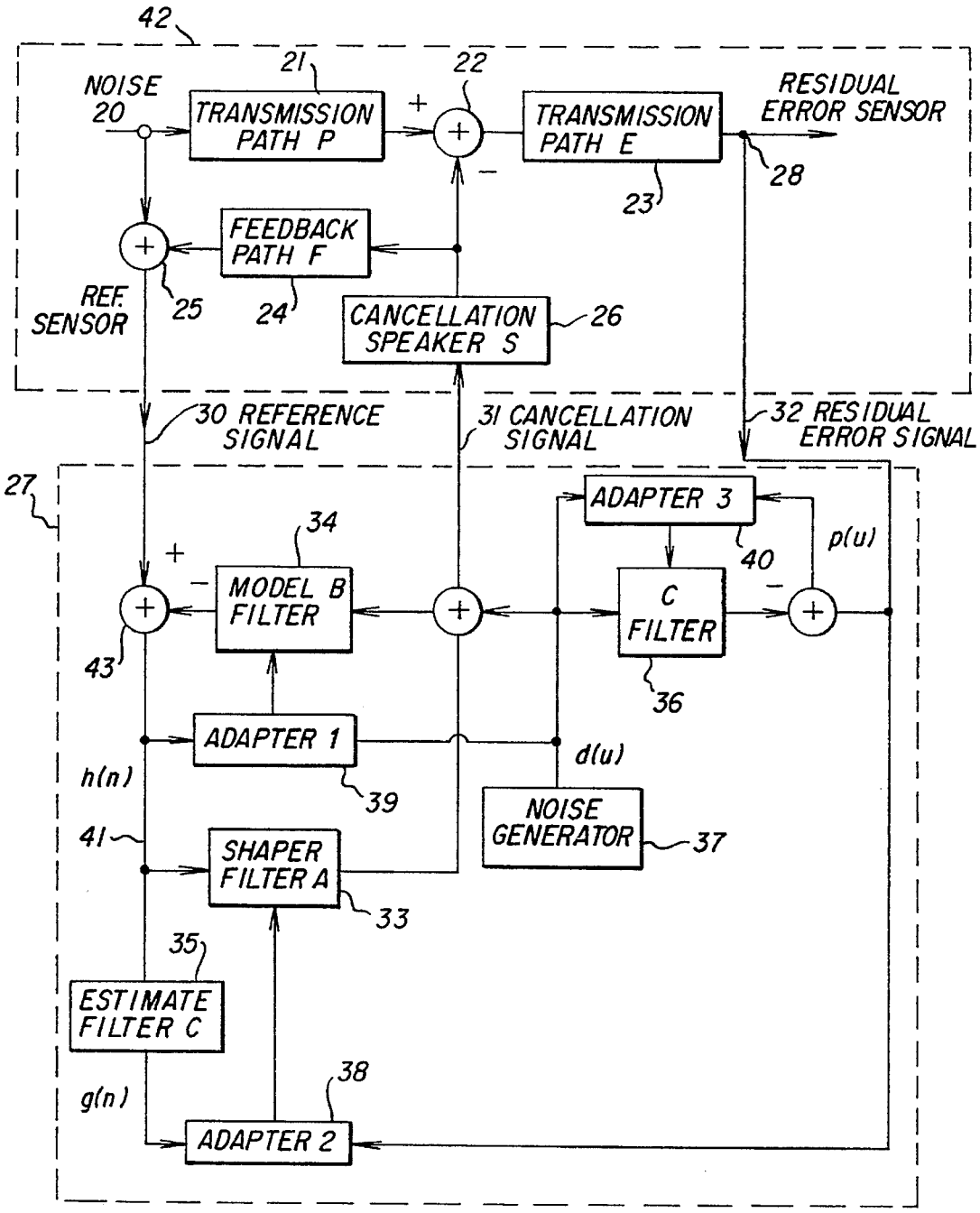

FIG. 4 shows a block diagram representation for the system seen in FIG. 3 and the associated DSP system to continuously attenuate the noise in sound conductor 11 in FIG. 3. FIG. 4 assumes that the system depicted in FIG. 3 can be broken down into components and modeled by linear, time invariant filters. For example, the acoustic path the noise travels can be broken down into a component from the reference sensor to the point in space where the noise and the anti-noise mix and a component from there to the residual error sensor.

The components of the physical system are seen in block 42. The transfer function P 21 represents the transmission path of the noise 20 from the reference sensor 25 to the cancellation transducer 26. Noise 20 is sensed by reference sensor 25. Block F 24 represents the acoustic feedback path from cancellation transducer 26 to the reference sensor 25. Block S 26 represents the cancellation transducer 26. Block E 23 represents the transmission path 23 from the cancellation transducer 26 to the residual error sensor 28. Reference sensor 25 is depicted as a summer because it senses both the noise 20 and the cancellation signal after passing through 26 and 24. The mixing of noise 20 after transmission path P 21, and cancellation signal 31 after cancellation transducer 26 is depicted at summer 22.

The adaptive noise canceller used in this invention is seen in block 27. Signal 30 is the reference signal, signal 32 is the residual error signal and signal 31 is the canceling signal. Blocks A 33, B 34 and C 35 are adaptive Finite Impulse Response (FIR) filters. The purpose of filter B 34 is to model the acoustic feedback of cancellation signal 31 through S 26 and F 24. Signal h(n) 41 is then the best estimate of noise in the duct after subtracting the acoustic feedback signal at summer 43. Filter A 33 then shapes the measured reference signal 30 to account for its propagation through P 21 in the duct and for cancellation signal 31 distortion through S 26. Filter C 36 is an estimate of canceling signal 31 through path S 6 and E 23.

When the system is canceling, filter A 33 is adjusted by adapter 2 38 to minimize residual error signal 32. To calibrate the system, filter A weights are set to zero and noise generator 37 is turned on. Adapter 1 39 then adjusts B 34 filter weights to model the path S 26 F 24. Adapter 3 40 adjusts C 36 filter weights to model the path S 26 E 23. Weights from filter C 36 are then used in filter C 35 during system cancellation to ensure convergence of the filter A 33 weights.

Figure 5:
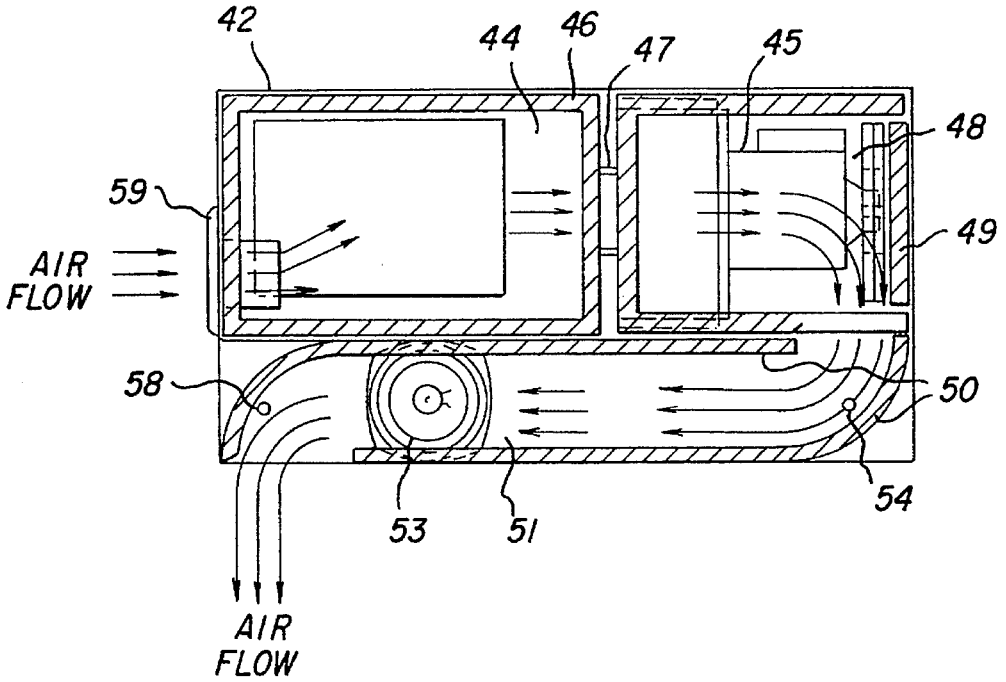
Figure 6:
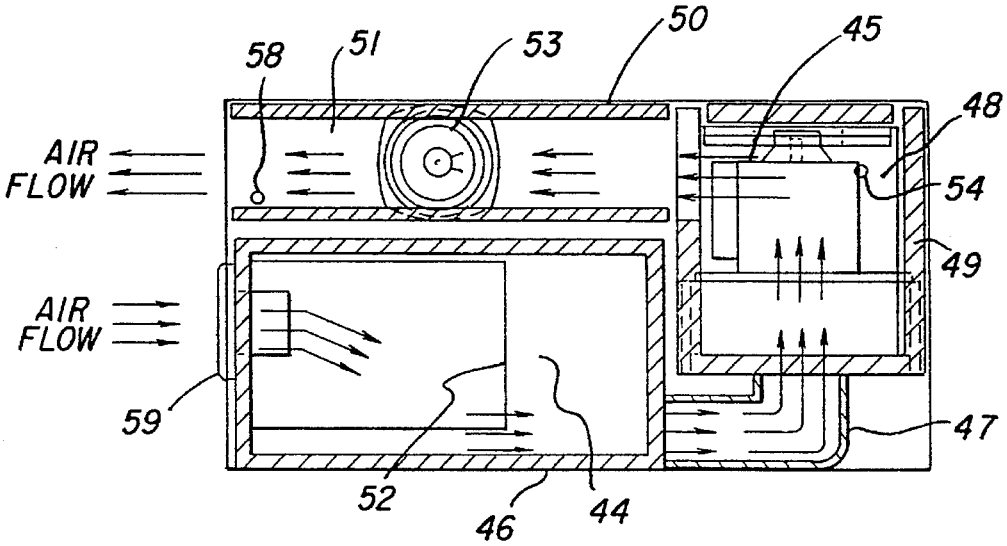
Figure 7:
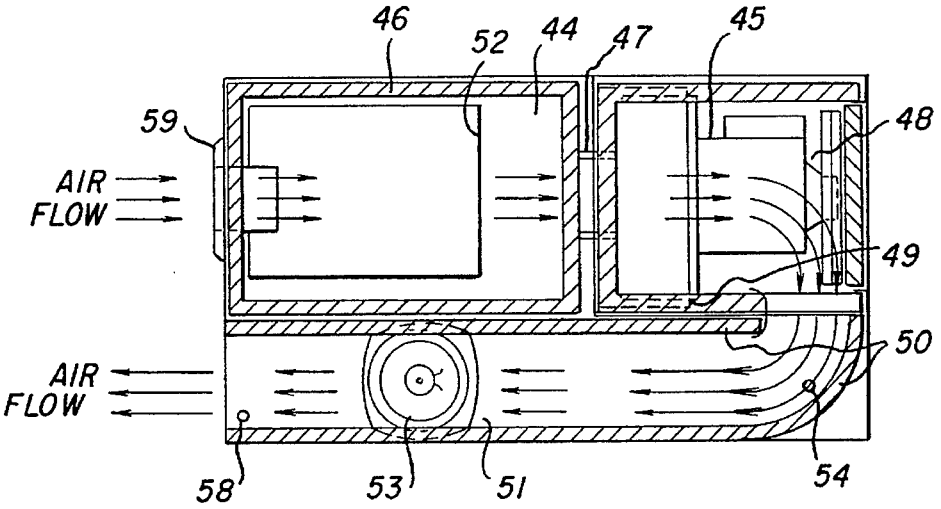
Figure 8:
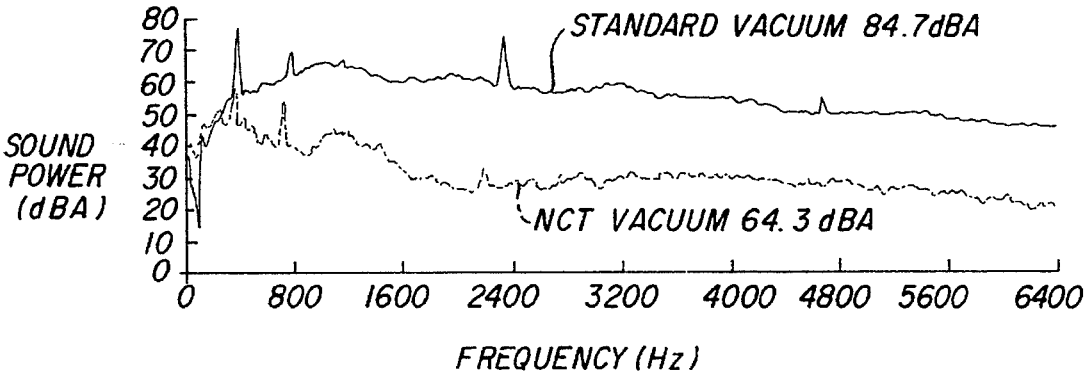
Figure 9:
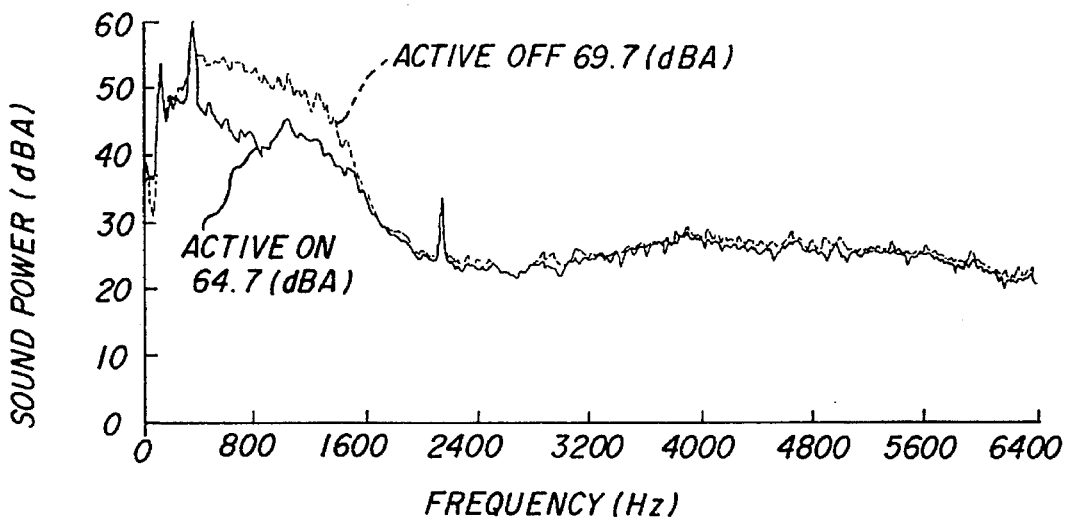
Figure 10:
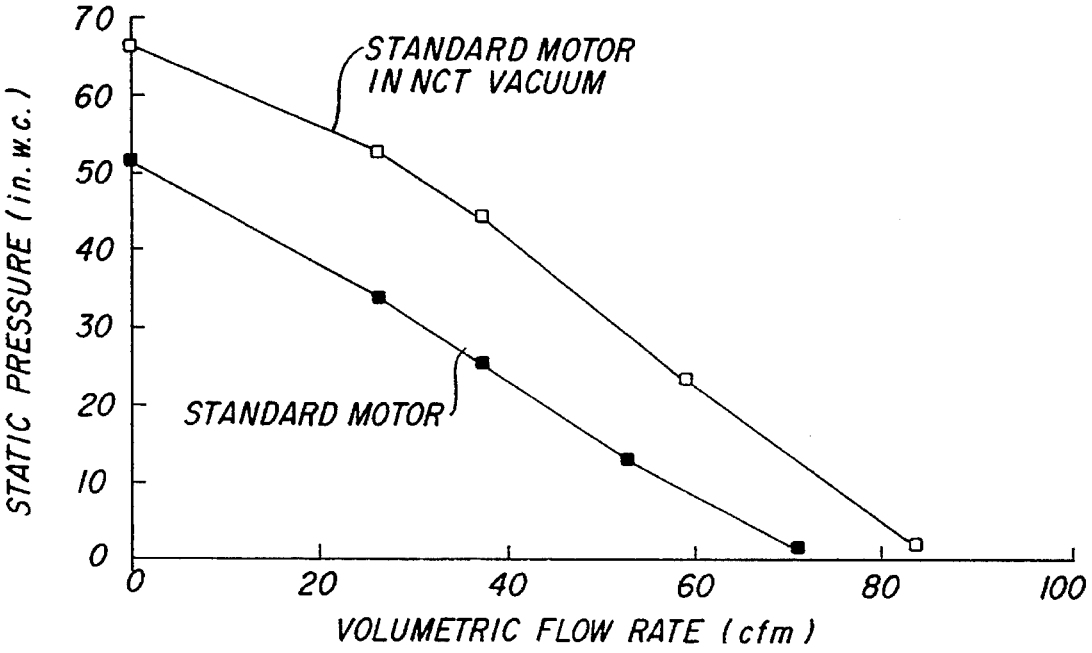

Referring to FIGS. 5, 6 and 7, there is shown the physical vacuum cleaner of this invention. The bag cavity 44 area is essentially an acoustically designed muffler. A muffler can be described as a section of duct or pipe shaped to reduce the transmission of sound while allowing the free flow of air. The vacuum inlet muffler must meet acoustical, aerodynamic, geometrical and mechanical criteria. The acoustic criteria specifies the amount of noise reduction required from the muffler as a function of frequency. Aerodynamically, the muffler should produce the minimum pressure drop so that the smallest rated motor/blower unit can be used. As will be mentioned later, using a smaller rated motor/blower unit 45 will result in quieter noise levels.

The muffler should also possess the smallest practical dimensions. Since muffler acoustic characteristics are highly dependent on geometry, there will be a tradeoff between muffler performance and geometry. The muffler must be mechanically sound as well, meaning that it must have enough structural rigidity so the wall will not collapse due to the negative pressure in the bag cavity area. In addition, acoustic foam used to line the surface of the muffler must have a cleanable, puncture resistant surface in case the bag breaks.

The muffler is acoustically described as a combination reactive/dissipative type muffler. The geometry of the muffler determines the acoustical performance of the reactive portion of the muffler. In principle, the acoustic energy traveling through the pipe is reflected back towards the source because of the impedance mismatch created by a change in cross-sectional area. The transmission loss (TL) for a given frequency range to be optimized is calculated by the following equation:

$$TL(dB)=10\log[1+\tfrac{1}{4}(m-1/m)^2\sin^2 kl]$$

where m=cross-sectional area of bag cavity 44/cross-sectional area of inlet pipe 59 k=wave number $-2\pi f/c$ where f=frequency (Hz) and c=speed of sound (in/sec)

L=length of bag cavity 44 The acoustic performance of the dissipative portion of the muffler is determined by the absorption properties of the passive acoustic material 46 used to line the inside of the muffler. The use of this material provides additional transmission loss to that described above as well as reducing resonances in the bag cavity. The transmission loss with the acoustic foam lining is calculated using the following equation:

$$TL(dB)=10\log\{[\cosh(\sigma l/2)+\tfrac{1}{2}(m+1/m)\sinh(\sigma/2]^2\cos^2 kl+[\sinh(\sigma l/2)+\tfrac{1}{2}(m+1/m)\cosh(\sigma/2]^2\sin^2 kl$$

where: $\sigma$=energy attenuation per unit length dB/m.

The coupling 47 between the bag cavity 44, lined with passive acoustic material 46, and motor chamber 48 is a flexible rubber tube. This coupling 47 helps quiet the vacuum in two ways. First, it provides a smooth flow path for the air that minimizes the noise produced by turbulence and separation. It is important that air flow coming into the entrance of the blower (fan) be as uniform as possible in order to keep fan noise to a minimum and fan efficiency at a maximum. Secondly, the flexible coupling 47 reduces the transmission of structural vibrations from the motor chamber to the bag cavity (muffler) walls. This is achieved through the large impedance difference between the motor chamber structure 43 and the flexible coupling 47. Because the coupling is lower in impedance, it reflects the structural vibration wave back towards the source similar to the case observed for the bag cavity. Obviously, the greater the impedance mismatch, the greater the attenuation of structure borne noise will be. However, the hose must be rigid enough to withstand the negative pressure created by the vacuum motor/blower 45.

The motor chamber 48 is the most important part of the vacuum acoustic design because it houses the primary noise source of the vacuum, the motor/blower unit 45. This motor chamber isolates the motor from the rest of the vacuum both acoustically and structurally by incorporating a semi-sealed chamber design. It is lined with passive acoustic material 49. It is important that all transmission paths be treated with some noise reduction method or else a sound "short" will exist allowing the acoustic or vibration energy to escape to the surrounding medium. The only openings are for the flow of air at the inlet coupling 47 and the exhaust duct 51. In essence, these represent acoustic sound shorts but they have been minimized by this design. On the inlet side, the use of a flexible coupling 47 and resulting cross-sectional area change impede the transfer of the acoustic energy to the bag cavity 44. In the exhaust duct 51, the use of passive acoustic absorber foam 50 and active noise cancellation by speaker 53 reduce motor noise significantly.

Motor/blower noise is comprised of both discrete frequency and broad band noise. Discrete frequency signals are produced by the electrical line frequency and its harmonics, the fundamental shaft frequency and harmonics, and the blade passing frequency of the fan(s) and harmonics. Broad band noise is produced by turbulent air flow over the motor cage and other surrounding discontinuities. The nature of the noise will dictate the noise control method to be used for the motor/blower chamber. High frequency noise, typically above 2000 Hz, can be attenuated using simplistic passive noise control methods. Acoustic foam is used to absorb the acoustic energy and convert into mechanical energy (i.e., heat) for the high frequency noise attenuation. This method is effective because the wavelengths of the sound are short in this frequency region allowing them to penetrate the material. However, low frequency noise must be attenuated using a more complex method because of the longer wavelengths tend to pass through the material. The use of massive and/or thick material will stop the transmission of the longer wavelengths. Thus, the material chosen for the motor chamber is a decoupled absorber/barrier foam 49. The barrier is massive enough to reflect low frequency noise into the exhaust duct 51 while the acoustic absorber face reduces the middle and higher frequencies.

Air used to cool the motor is vented through an exhaust duct 51. The exhaust is vented out the back away from the operator to minimize the noise the operator hears. The duct 51 is attached to the motor chamber 48 and extends past the length of the motor chamber. This design purposely forces motor noise into the duct because this vacuum, unlike any existing vacuum design, utilizes active noise cancellation in an unbent duct in a very short distance to cancel the low frequency noise that is not attenuated by passive noise control measures. The duct 51 is a primary source of noise because of the turbulent flow in the duct and discrete frequency motor noise. As previously discussed in the design of the motor chamber 48, passive noise control works for the high frequency. In this case, acoustic absorbing foam 50 lines the ductwork to attenuate the high frequency. For low frequency control, active noise cancellation is employed for the first time on a vacuum with a shirt length of unbent ductwork. Active noise control is necessary for the low frequency because passive noise control methods would require very thick and massive materials that would cause the vacuum to be bigger and heavier than necessary.

Microphones 54, 58, a sensing microphone and a residual microphone, respectively, are connected to DSP controller 15, as is speaker 51, which operates in a conventional feedforward manner to cancel both tonal and broadband noise. Such systems are commonplace and have been sold as Model 2000 Controller by Noise Cancellation Technologies, Inc. Existing systems are shown in U.S. Pat. Nos. 4,122,303, 4,480,333 and 4,423,289, all owned or licensed by the assignee of this application. Microphones, 54 and 58, are placed along the exhaust duct and act as a noise and residual error sensor, respectively, to sense noise to be canceled and to provide feedback. The active canceling noise is broadcast into the duct via speaker 53 to counter the existing noise in the duct and is run by controller 52. Controller 52 houses the power supply and processor having the cancellation algorithm, Structured Adaptive FeedForward (SAFF).

Having described the invention it will become apparent to those of ordinary skill in the art that many changes and modifications can be made without departing from the scope of the appended claims.

We claim:

1. A vacuum cleaner system adapted to cancel both tonal and broadband noise for quiet operation, said system comprising an inlet means adapted to allow for the intake of solids and liquids, motor/blower means associated with said inlet means and adapted to provide negative pressure at said inlet means to facilitate the intake of said solids and liquids, said inlet means includes a cavity area which is acoustically designed to produce the lowest pressure drop and the cross-sectional area of the inlet means is adapted to impede the transfer of the acoustic energy to the cavity, collection means associated with said inlet means so as to collect solids and liquids that are drawn into said inlet means by said negative pressure, a relatively short, straight exhaust means, active noise control means associated with said system and adapted to measure both tonal and broadband noise, the noise generated by said system, compensate for feedback from speaker to reference microphone and to produce an equal and opposite counter noise in said exhaust means so as to reduce the system generated noise.

2. A vacuum cleaner system as in claim 1 wherein said motor/blower means includes a sealed chamber means which is adapted to isolate the motor from the remainder of the vacuum system both acoustically and structurally.

3. A vacuum cleaner system as in claim 2 wherein said chamber means has an air inlet and said exhaust means being a straight duct and relatively short in relationship to said system.

4. A vacuum cleaner system as in claim 3 wherein said chamber air inlet is connected to said cavity means by a flexible coupling to provide for a smooth flow to minimize noise produced by turbulence and separation and to reduce structural vibrations.

5. A vacuum cleaner system as in claim 4 wherein there is a large impedance difference between said chamber and said flexible coupling.

6. A vacuum cleaner system as in claim 4 wherein said chamber means is constructed as a decoupled absorber/barrier which allows for reduction of low frequency noise while absorbing high frequency noise.

7. A vacuum cleaner system as in claim 1 wherein said exhaust means includes an exhaust duct which conducts cooling air used to cool said motor/blower means out of said system, said exhaust duct being straight and relatively short in relation to said system and having a loudspeaker means mounted thereon.

8. A vacuum cleaner system as in claim 7 wherein said active noise control means includes sensing means in the path of air passing through said exhaust duct to sense the noise and introduce a signal to said control means which is adapted to emit a noise canceling signal to said loudspeaker means.

9. A vacuum cleaner system as in claim 8 wherein said speaker means located in said exhaust duct means to allow for counter noise to interdict the motor/blower produced noise to cancel it including a speaker located adjacent the terminus of said exhaust duct, whereby counter noise can be introduced into said duct to cancel both tonal and broadband noise contained therein.

* * * * *